US005518212A

United States Patent [19]

Sigler

[11] Patent Number: 5,518,212

[45] Date of Patent: May 21, 1996

[54] TRASH BAG HOLDING FRAME

[76] Inventor: Robert W. Sigler, Rte. 1 Box 190-27, Niota, Tenn. 37826

[21] Appl. No.: 316,502

[22] Filed: Sep. 29, 1994

[51] Int. Cl.[6] ..... B65B 67/04

[52] U.S. Cl. ..... 248/101

[58] Field of Search ..... 248/99, 95, 97, 248/100, 101, 98; 220/404; 141/314, 391

[56] References Cited

U.S. PATENT DOCUMENTS 1,121,388 12/1914 Milks ..... 248/95
1,449,285 3/1923 Hilton ..... 248/101
1,922,938 8/1933 Elliott ..... 248/97
2,643,842 6/1953 Diserens ..... 248/97

*Primary Examiner*—Ramon O. Ramirez

[57] ABSTRACT

A frame for holding the mouth of a flexible bag in an open configuration. The inventive device includes a hoop having a pair of lateral arms pivotally mounted thereto. The lateral arms each comprise a curved length of tubing having a semi-cylindrical cross section engagable over the hoop to capture the mouth of the bag between the arms and the hoop.

2 Claims, 3 Drawing Sheets

TRASH BAG HOLDING FRAME

BACKGROUND OF THE INVENTION

1. Field of the Invention

The present invention relates to holding structures and more particularly pertains to a trash bag holding frame for holding the mouth of a flexible bag in an open configuration.

2. Description of the Prior Art

The use of holding structures is known in the prior art. More specifically, holding structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art holding structures include U.S. Pat. No. 4,946,118; U.S. Pat. No. 3,815,778; U.S. Pat. No. 3,927,445; and U.S. Pat. No. 3,958,785.

While these devices fulfill their respective, particular objectives and requirements, the aforementioned patents do not disclose a trash bag holding frame for holding the mouth of a flexible in an open configuration which includes a hoop having a pair of lateral arms pivotally mounted thereto, wherein the lateral arms each comprise a curved length of tubing having a semi-cylindrical cross section engagable over the hoop to capture the mouth of the bag between the arms and the hoop.

In these respects, the trash bag holding frame according to the present invention substantially departs from the conventional concepts and designs of the prior art, and in so doing provides an apparatus primarily developed for the purpose of holding the mouth of a flexible bag in an open configuration.

SUMMARY OF THE INVENTION

In view of the foregoing disadvantages inherent in the known types of holding structures now present in the prior art, the present invention provides a new trash bag holding frame construction wherein the same can be utilized for holding the mouth of a flexible bag in an open configuration. As such, the general purpose of the present invention, which will be described subsequently in greater detail, is to provide a new trash bag holding frame apparatus and method which has many of the advantages of the holding structures mentioned heretofore and many novel features that result in a trash bag holding frame which is not anticipated, rendered obvious, suggested, or even implied by any of the prior art holding structures, either alone or in any combination thereof.

To attain this, the present invention generally comprises a frame for holding the mouth of a flexible bag in an open configuration. The inventive device includes a hoop having a pair of lateral arms pivotally mounted thereto. The lateral arms each comprise a curved length of tubing having a semi-cylindrical cross section engagable over the hoop to capture the mouth of the bag between the arms and the hoop.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new trash bag holding frame apparatus and method which has many of the advantages of the holding structures mentioned heretofore and many novel features that result in a trash bag holding frame which is not anticipated, rendered obvious, suggested, or even implied by any of the prior art holding structures, either alone or in any combination thereof.

It is another object of the present invention to provide a new trash bag holding frame which may be easily and efficiently manufactured and marketed.

It is a further object of the present invention to provide a new trash bag holding frame which is of a durable and reliable construction.

An even further object of the present invention is to provide a new trash bag holding frame which is susceptible of a low cost of manufacture with regard to both materials and labor, and which accordingly is then susceptible of low prices of sale to the consuming public, thereby making such trash bag holding frames economically available to the buying public.

Still yet another object of the present invention is to provide a new trash bag holding frame which provides in the apparatuses and methods of the prior art some of the advantages thereof, while simultaneously overcoming some of the disadvantages normally associated therewith.

Still another object of the present invention is to provide a new trash bag holding frame for holding the mouth of a flexible bag in an open configuration.

Yet another object of the present invention is to provide a new trash bag holding frame which includes a hoop having a pair of lateral arms pivotally mounted thereto, wherein the lateral arms each comprise a curved length of tubing having a semi-cylindrical cross section engagable over the hoop to capture the mouth of the bag between the arms and the hoop.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
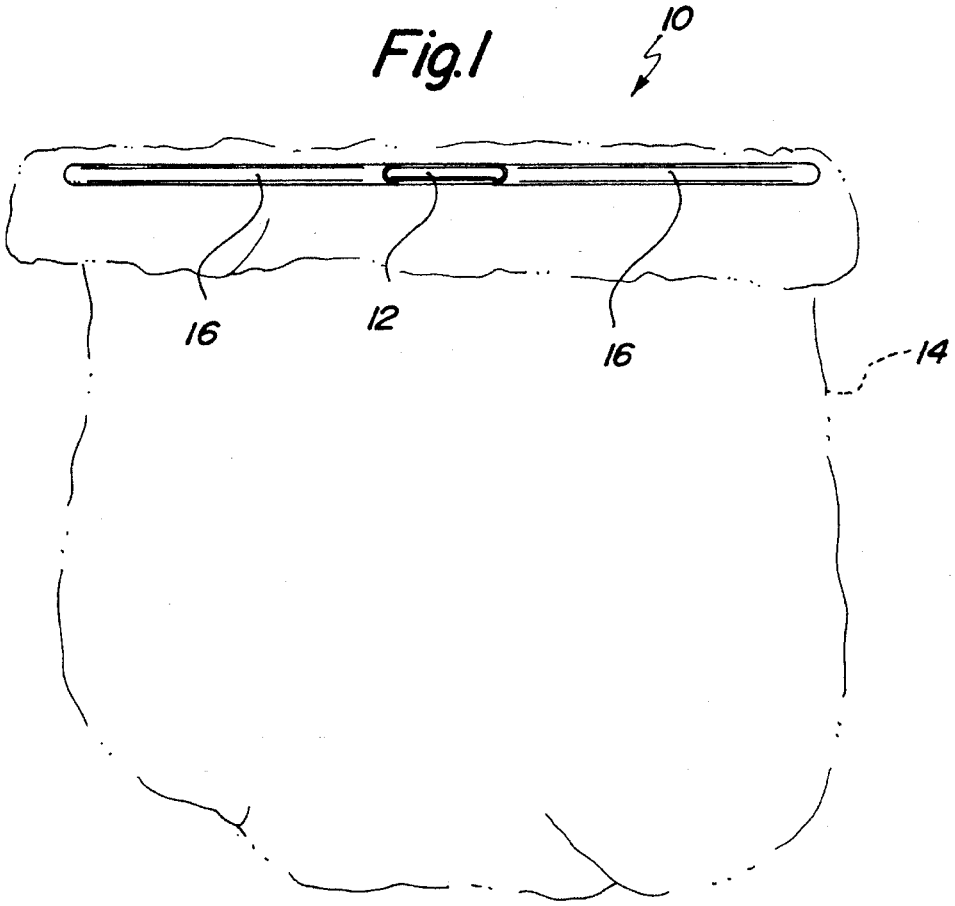
FIG. 1 is a front elevation view of a trash bag holding frame according to the present invention.

With reference now to the drawings, and in particular to FIGS. 1–6 thereof, a new trash bag holding frame embodying the principles and concepts of the present invention and generally designated by the reference numeral 10 will be described.

Figure 2:
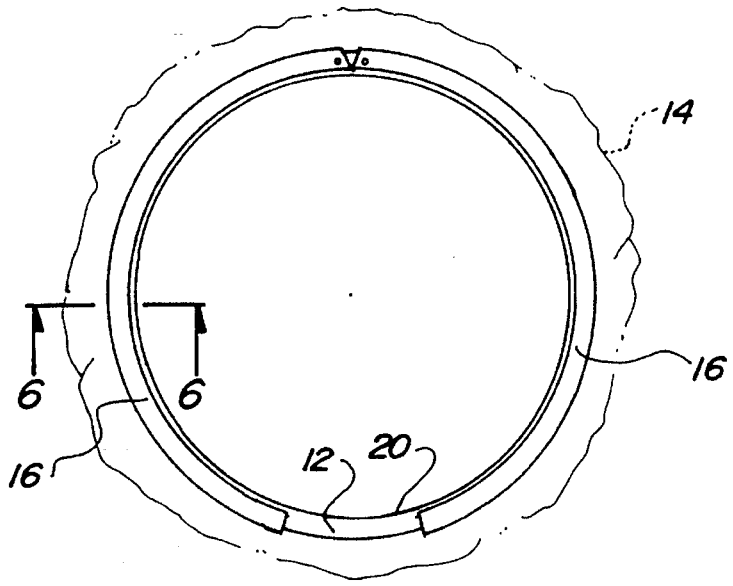
FIG. 2 is a top plan view of the trash bag holding frame.
Figure 3:
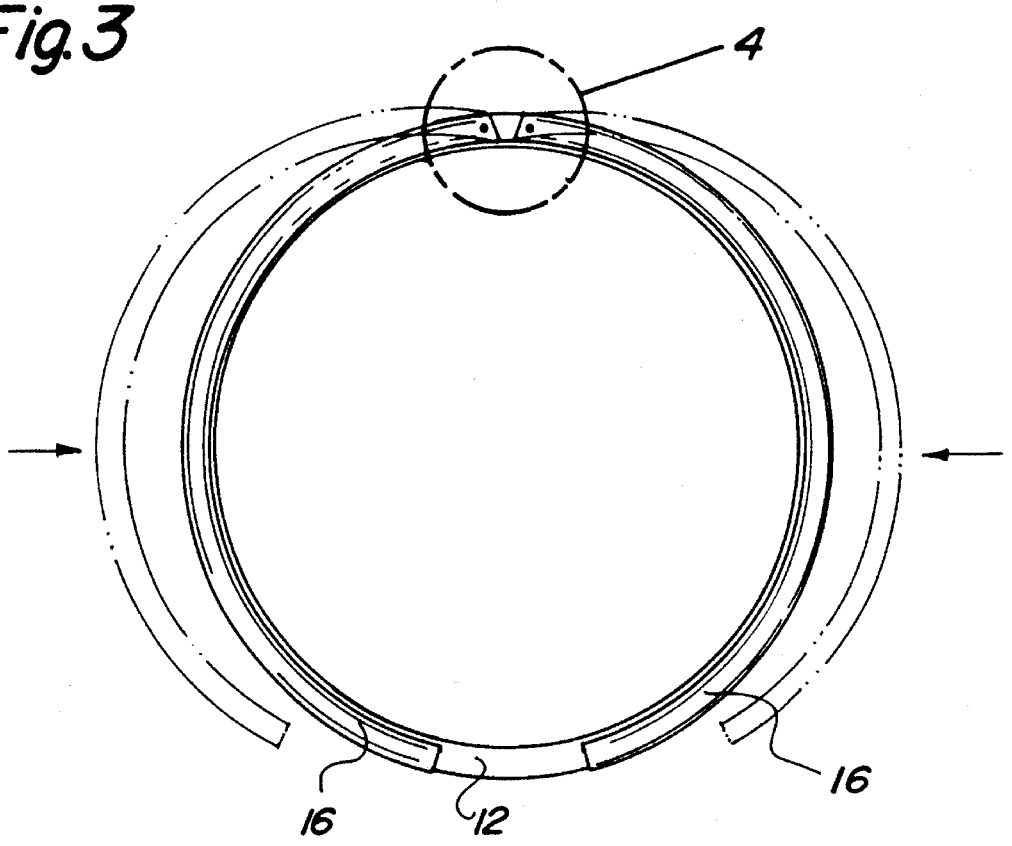
FIG. 3 is a top plan view of the invention, per se.
Figure 4:
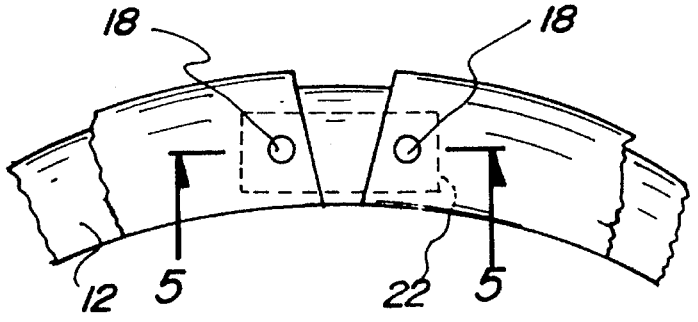
FIG. 4 is a enlarged view of the area set forth in FIG. 3.
Figure 6:
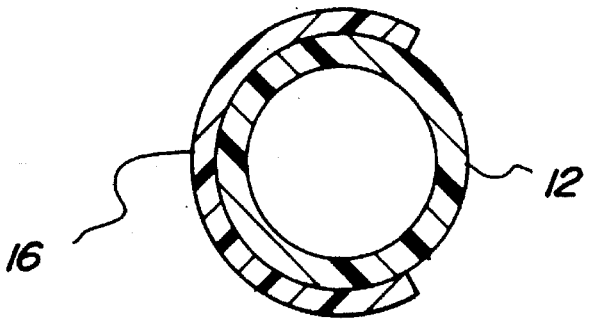
FIG. 6 is a further cross sectional view taken along line 6—6 of FIG. 2.

More specifically, it will be noted that the trash bag holding frame 10 comprises a substantially circular hoop 12 having a preferably circular cross section, as shown in FIG. 6, and sized to extend about a circumferential periphery of the mouth of a trash bag 14, as shown in FIG. 1. The hoop 12 is preferably constructed of a substantially resilient or flexible material such as plastic or the like such that resilient deformation of the hoop during insertion and manipulation thereof relative to the trash bag 14 can be more easily accomplished. As shown in FIG. 2, a pair of lateral arms 16 are pivotally mounted to the hoop 12 by a pair of pivot pins 18. The lateral arms 16 each comprise a curved length of tubing having a semi-cylindrical cross section, as shown in FIG. 6, which can be resiliently deformed so as to be positioned about the hoop 12, whereby the resilient nature of the lateral arms will cause a radial contraction of the side walls thereof about the hoop to retain the lateral arms relative to the hoop. By this structure, an unlabeled mouth of the trash bag 14 can be folded about the hoop 12 and captured between the hoop and the lateral arms 16 to secure the device 10 relative to the trash bag 14.

Figure 5:
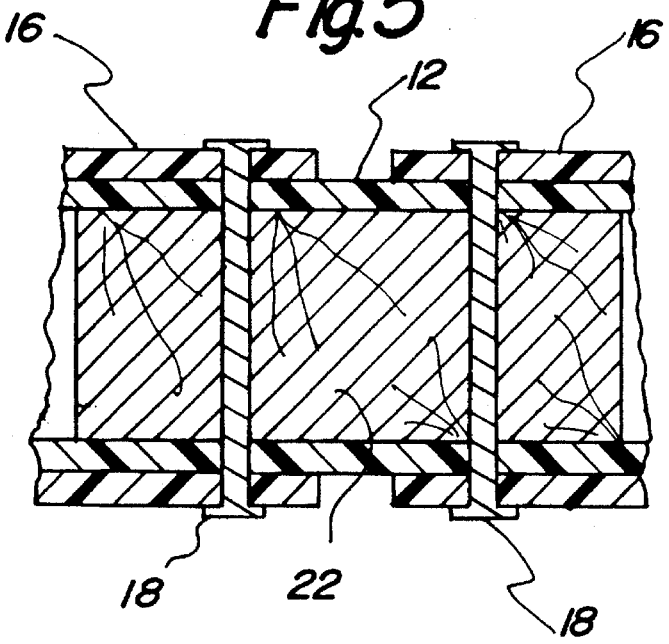
FIG. 5 is a cross sectional view taken along line 5—5 of FIG. 4.

Preferably, the lateral arms 16 extend about diametrically opposed portions of the hoop 12 and are pivotally mounted at first ends thereof by the pivot pins 18, with the second ends of the lateral being spaced a sufficient distance apart so as to define handle portion 20 of the hoop 12 which can be grasped and manipulated by an individual utilizing the device 10. As shown in FIG. 5, a dowel 22 is preferably positioned within an interior of the hoop 12, with the pivot pins 18 extending through both the hoop and the dowel to pivotally mount the lateral arms 16 as described above. The dowel 22 serves to impart rigidity to the hoop 12 and the area thereof whereat the lateral arms 16 are pivotally mounted.

In use, the trash holding frame 10 according to the present invention can be easily inserted within or about the open mouth of an associated trash bag 14. The mouth portion of the trash bag 14 can then be folded about the hoop 12 with the lateral arms 16 positioned in an open configuration, as illustrated in phantom in FIG. 3, whereby a pivotal closing of the lateral arms 16 and subsequent engagement thereof to the hoop 12 will capture the bag 14 between the lateral arms and the hoop 12 to secure the trash bag 14 in an open configuration for loading thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A trash bag holding frame comprising:

a substantially circular hoop having a circular cross section;

a pair of lateral arms pivotally mounted to said hoop, said lateral arms being removably couplable over said hoop to capture a portion of a bag between said lateral arms and said hoop, said lateral arms each comprising a curved length of tubing having a semi-cylindrical cross section defining side walls which can be resiliently deformed so as to be positioned about said hoop, wherein a resilient nature of said lateral arms will cause a radial contraction of said side walls about said hoop to retain said lateral arms relative to said hoop, said lateral arms extending about diametrically opposed portions of said hoop and being pivotally mounted at first ends thereof by a pair of pivot pins, said lateral arms each including a second end, with said second ends of said lateral arms being spaced a distance apart when engaged to said hoop so as to define a handle portion of said hoop which can be grasped and manipulated by an individual;

and, a dowel positioned within an interior of said hoop, with said pivot pins extending through both said hoop and said dowel to pivotally mount said lateral arms relative to said hoop.

2. A trash bag holding frame comprising:

a substantially circular hoop;

a pair of lateral arms pivotally mounted to said hoop, said lateral arms being removably couplable over said hoop to capture a portion of a bag between said lateral arms and said hoop, said lateral arms each comprising a curved length of tubing having a semi-cylindrical cross section defining said walls which can be resiliently deformed so as to be positioned about said hoop, wherein a resilient nature of said lateral arms will cause a radial contraction of said side walls about said hoop to retain said lateral arms relative to said hoop, said lateral arms extending about diametrically opposed portions of said hoop and being pivotally mounted at first ends thereof by a pair of pivot pins, said lateral arms each including a second end, with said second ends of said lateral being spaced a distance apart when engaged to said hoop so as to define handle portion of said hoop which can be grasped and manipulated by an individual;

and, a dowel positioned within an interior of said hoop, with said pivot pins extending through both said hoop and said dowel to pivotally mount said lateral arms relative to said hoop.

* * * * *